US005904076A

United States Patent [19]

Siwy

[11] Patent Number: 5,904,076

[45] Date of Patent: May 18, 1999

[54] NUT REMOVAL DEVICE

[76] Inventor: Charles C. Siwy, 33 Smallwood Drive, West Seneca, N.Y. 14224

[21] Appl. No.: 08/958,965

[22] Filed: Oct. 28, 1997

[51] Int. Cl.[6] ..... B25B 13/06

[52] U.S. Cl. ..... 81/121.1; 81/119; 81/186; 81/53.2

[58] Field of Search ..... 81/53.2, 119, 121.1, 81/186

[56] References Cited

U.S. PATENT DOCUMENTS

| | | | |
|---|---|---|---|
| 574,622 | 1/1897 | Olden . | |
| 996,841 | 7/1911 | Dixon . | |
| 1,954,141 | 4/1934 | Miquelon . | |
| 2,334,069 | 11/1943 | Collins et al. . | |
| 2,671,368 | 3/1954 | Diebold . | |
| 3,252,359 | 5/1966 | Bodkin . | |
| 3,280,671 | 10/1966 | Woodling | 81/186 |
| 3,602,073 | 8/1971 | Siwersson et al. . | |
| 3,757,614 | 9/1973 | Evans et al. . | |
| 3,785,226 | 1/1974 | Ward . | |
| 3,881,377 | 5/1975 | Evans et al. . | |
| 3,885,480 | 5/1975 | Muenchinger . | |
| 3,903,764 | 9/1975 | Andersen . | |
| 4,167,882 | 9/1979 | Siwersson . | |
| 4,440,047 | 4/1984 | Robbins . | |
| 4,607,547 | 8/1986 | Martus | 81/53.2 |
| 5,148,726 | 9/1992 | Huebschen et al. . | |
| 5,219,392 | 6/1993 | Ruzicka et al. . | |

*Primary Examiner*—James G. Smith
*Attorney, Agent, or Firm*—Simpson, Simpson, & Snyder

[57] ABSTRACT

A device is disclosed for removing a nut frozen is place regardless of the degree to which the corners of the nut have been rounded by a prior attempt to remove such nut by an ordinary wrench. The device is formed with an opening, which is sized to receive the nut and formed with a plurality of teeth preferably arranged such that a leading or cutting edge of each tooth engages approximately with a midpoint of a flat of the nut. The front and rear faces of each tooth form an angle of less than 90° and a gullet between teeth, which is defined by a rear face of one tooth and a front face of a next adjacent tooth, is sized to freely receive the corner(s) between the flats with which the leading edges of an adjacent pair of teeth engage. The gullet is shaped and sized to permit the formation of a chip upon penetration of a leading edge into a flat of a nut, which is operable to lock the nut for rotation with the device.

9 Claims, 1 Drawing Sheet

NUT REMOVAL DEVICE

BACKGROUND OF THE INVENTION

It is oftentimes found that nuts become frozen on a bolt due to the build-up of rust on their mounting threads and/or due to the improper threading of the nut onto the bolt. The resultant tight fit makes it extremely difficult to remove the nut by manual manipulations of a conventional wrench with the result that the nut, which is typically formed of relatively soft metal as compared to the wrench, has its corners rounded off due to slippage of the wrench. When this occurs, a wrench is no longer able to effectively grip the nut and a saw, torch or special cutting tool is required to be employed to remove the damaged nut.

SUMMARY OF THE INVENTION

The present invention is directed to a device adapted to facilitate removal of a nut from a bolt even when such nut is severely damaged by having its corners rounded off incident to prior unsuccessful removal attempts to a degree that the nut can no longer be properly engaged by a conventional wrench or the like.

More particularly, the present device includes at least one pair of facing teeth, each tooth having a cutting edge arranged to operatively engage with a midportion of one of a pair of parallel, oppositely facing flats of a conventional square or hexagon nut for which the device is designed for use. Each of the teeth is bounded by front and rear tooth faces or surfaces extending from the cutting edge and forming an angle of less than 90° and a concave surface joined to the front face remotely of its adjacent cutting edge.

The cutting edge of each tooth is arranged to engage adjacent a mid-portion of one of the flats of the nut, and its associated rear tooth face preferably includes a first part arranged to extend from adjacent such mid-portion to a corner defined by such flat and an adjacent flat, and a second part arranged to extend from the first part to the concave surface serving to join the rear tooth face to the front tooth face of an adjacent tooth. The second parts of the rear faces of a pair of facing teeth preferably lay along a circle whose diameter is equal to the distance between the junctures of the first and second parts of the rear faces of the pair of facing teeth.

The first parts of the rear faces of a pair of facing teeth of the present device are preferably parallel and, together with their adjacent cutting edges, are spaced apart through a distance which has a value equal to about the maximum design distance between a pair of oppositely facing flats of a given size nut plus 0.000 inch and minus 0.003 inch. The distance between the junctures of the first and second parts of the rear faces of a pair of facing teeth, together with the distance between such second parts or the diameter of the circle they describe, preferably corresponds to a valve equal to about the maximum design distance between a pair of opposite corners of such given size nut plus 0.000 inch and minus 0.010 inch.

With the above construction, the teeth of the present device are adapted to firmly engage against the flats of a nut for purposes of exerting an unthreading force, as an incident to exertion of counterclockwise-directed force to the device for the case of a right hand nut. If the nut does not immediately begin to move in a counterclockwise direction relative to the bolt on which it is threaded, the cutting edges of the teeth bite into the side faces to eventually form chips whose sizes increase as the device rotates relative to the nut until the chips effectively fill cavities of the device defined by the front face of each tooth and the second part of the rear tooth face of an adjacent tooth leading in the direction of rotation. When this occurs, the device and nut become positively locked together for counterclockwise-directed movement, for the case of a right hand nut, and the nut will either begin to loosen relative to its supporting bolt, or that portion of the bolt frozen to the nut will be twisted off.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
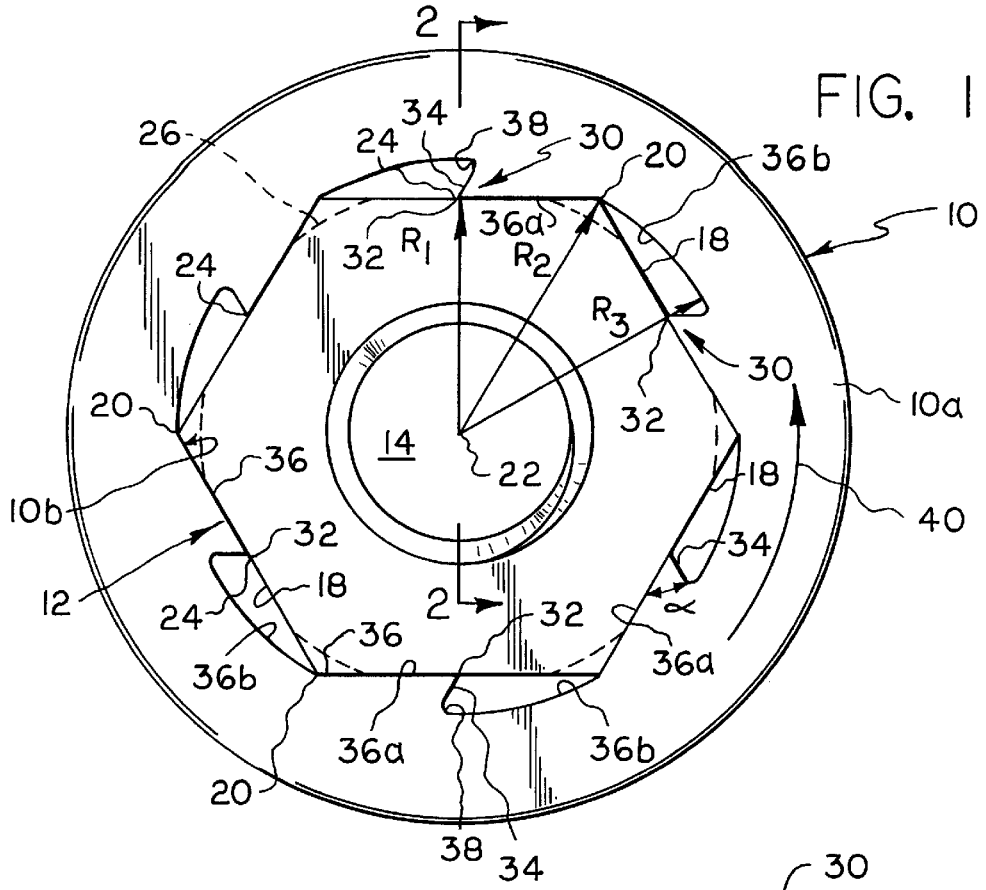
FIG. 1 is a top plan view of a nut removal device formed in accordance with the present invention shown in association with a nut of hexagonal configuration.
Figure 2:
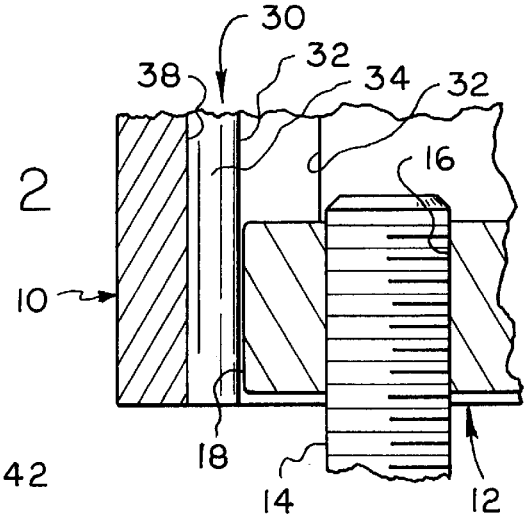
FIG. 2 is a sectional view taken generally along the line 2—2 in FIG. 1.

Reference is first made to FIGS. 1 and 2 wherein a nut removal device formed in accordance with the present invention is generally designated as 10 and shown in association with a conventional nut 12 of hexagonal configuration threadably mounted on a bolt 14.

To facilitate understanding of the present invention, nut 12 will first be generally described as having a centrally-disposed threaded opening 16 for threadably receiving bolt 14, and six (6) like sized flats 18 joined to adjacent flats at corners 20. Radius $R_1$ represents the maximum design distance for a given size nut, as measured between an axis 22 of opening 16 to the mid-portion or center 24 of each of flats 18, and $R_2$ represents the maximum design distance for such nut, as measured between axis 22 and each of corners 20. Typically, the size of any given nominal size of nut will vary between a known minimum design value and a known maximum design valve, as a result of manufacturing tolerances, which are readily available by consulting standard engineering handbooks.

Broken lines 26 are employed to indicate the rounding off of corners 20, which commonly occurs when a conventional wrench or socket, not shown, slips or rotates relative to nut 12 during an attempted removal operation performed on such nut after it has become frozen in place on bolt 14, due for example to rust present between their associated threads or the improper threading of the nut onto the bolt. Present nut removal device 10 permits removal of nuts, which have become deformed by initial use of a conventional wrench. However, it will be understood that the present device may also be employed to remove nondeformed nuts, whether or not same are frozen in place on a bolt.

Again referring to FIGS. 1 and 2, it will be understood that device 10 is shown for example as being in the form of a conventional socket having a body portion 10*a* formed with an opening 10*b* sized to receive nut 12. Opening 10*b* is modified in accordance with the present invention to define a plurality of like teeth 30 arranged one for engagement with each of flats 18 adjacent its midpoint 24. Each of teeth 30 includes a relatively sharp cutting edge 32, a front face 34 and a rear face 36, wherein the front and rear faces are arranged at an angle of less than 90° and cooperate to define the cutting edge. As formed, the cutting edges of teeth 30 are parallel and have like lengths preferably equal to or greater than the thickness of nut 12, as measured lengthwise of axis 22 and shown in FIG. 2. Preferably, rear face 36 of one tooth is connected by a concave surface 38 to front face 34 of an adjacent tooth, which trails relative to the direction of nut removal rotation of device 10 shown by arrow 40.

Rear face 36 is shown as having first and second parts 36*a* and 36*b*, wherein first part 36*a* extends from cutting edge 32, and second part 36*b* extends between first part 36*a* and concave surface 38 of a trailing tooth. Preferably, first parts 36*a* of oppositely disposed teeth 30 are parallel, and each has a length equal to about one-half the length of a flat 18, as measured between its midportion 24 and one of its corners 20, and second parts 36*b* lie along arcs of a common circle, whose radius $R_3$ is such that second parts 36*b* are adapted to bridge aligned corners 20, as device 10 rotates relative to nut 14 in the direction of arrow 40.

As with conventional sockets, devices 10 would preferably be provided in sets having a plurality of nominal sizes corresponding to the nominal sizes of nuts with which they are desired to be employed. In all cases, a given size device would have the distance between its facing pairs of first portions 36*a* and 36*a*, and between the junctures of such first parts with their adjacent second parts 36*b*, sized to receive a given size nut having a maximum design distance between its opposite flats and corners.

Specifically, it is contemplated that each device will be formed such that the first parts 36*a* of its facing teeth 30 are spaced apart through a distance equal to the maximum design distance between a pair of oppositely facing flats of a given size nut (i.e. $2\times R_1$) plus 0.000 inch and minus 0.003 inch. Each device would also be formed such that the junctures of the first and second parts of its facing rear faces 36 are spaced apart through a distance corresponding to the maximum design distance between a pair of oppositely facing corners 20 of such given size nut (i.e. $2\times R_2$) plus 0.000 inch and minus 0.010 inch. The value of $R_3$ would preferably correspond to the distance between junctures of the first and second parts of facing rear surfaces 36. This size relationship is effective, for example, for standard square and octagonal nuts within a ¼ inch to 1 1/16 inch size range. For a few nuts of maximum design dimension lying within this range, device 10 will have to be forced thereonto, but for the vast majority of nuts, the device may be freely slid into place.

When device 10 is placed on nut 12 and turned in the direction of arrow 40, cutting edges 32 are brought into firm engagement with midportion 24 of an associated or facing flat 18, and the force thus applied is sufficient to rotate the nut relative to bolt 16 for instances where the nut is not frozen in place. When a partially frozen nut is encountered, teeth 30 progressively bite into nut flats 18 until sufficient force is applied to free the nut. For those cases where a nut is firmly frozen to a bolt, each of teeth 30 bites into its adjacent flat 18 sufficiently to form a chip, which progressively increases in size until it effectively fills a cavity or gullet, defined by a front face 34 extending from the penetrating cutting edge 32 of such tooth and the second part 36*b* of an adjacent leading tooth. This results in device 10 and nut 12 becoming positively locked together, such that the continued application of turning force to the nut either serves to brake the nut free of its bolt or to turn off such bolt. The presence of concave surface 38 serves to smoothly turn or roll the leading edge of the forming chip onto its adjacent second part 36*b* to facilitate chip formation and smooth operation of device 10.

Figure 3:
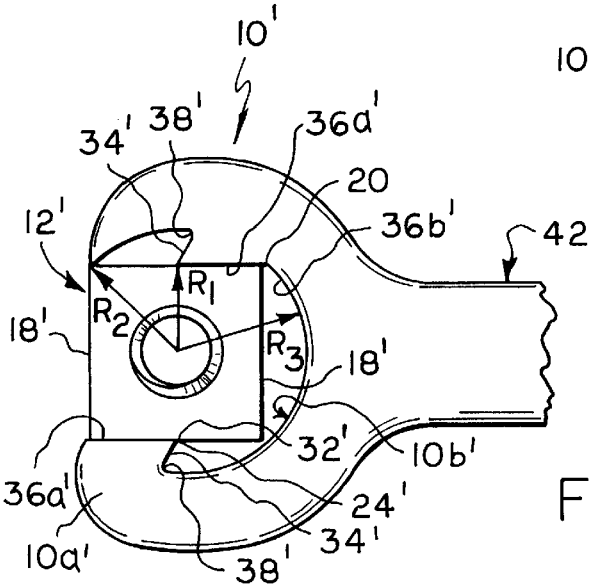
FIG. 3 is a top plan view of an alternative form of the device shown in association with a nut of square configuration.

FIG. 3 shows an alternative form of the device 10' of the present invention defined by a hand operated wrench 42 and arranged in association with a square nut 12'. Parts of device 10' and nut 12', which correspond to like parts shown in FIG. 1 are designated by like primed numerals.

While the device of the present invention has been described for use with the typical right hand nut, it will be understood that such device may be inverted relative to its orientation shown in the drawings, so as to permit its use with left hand nuts.

What is claimed is:

1. A device for removing a nut frozen in place on a bolt, said nut having a threaded opening and pairs of oppositely facing flats joined to adjacent ones of said pairs by corners, said flats being spaced a first distance from an axis of said threaded opening and said corners being spaced a second distance from said axis wherein said device comprises:

a body portion having an opening for receiving said nut, said opening defines at least one pair of teeth arranged to face one of said pairs of oppositely facing flats, each of said teeth having a cutting edge arranged to engage one of said flats of one of said pairs of flats, a front face and a rear face, said front and rear faces cooperating to define said cutting edge and being arranged at an angle of less than 90°, said rear face having a first part extending from said cutting edge and a second part extending from said first part and being connected to said front face of a next adjacent tooth by a concave surface.

2. A device according to claim 1, wherein said first parts of said rear faces of said pair of teeth are parallel and arranged for facing relationship with said flats.

3. A device according to claim 1, wherein said nut has two pairs of flats and said device has one pair of teeth.

4. A device according to claim 1, wherein said nut has three pairs of flats, and said device has three pairs of teeth.

5. A device according to claim 1, wherein said first parts of each pair of teeth are parallel and arranged in a closely-spaced facing relationship with said pair of flats with which said cutting edges of said pair of teeth engage.

6. A device according to claim 5, wherein said second parts extend generally along arcs of a common circle.

7. A device for removing a nut frozen in place on a bolt, said nut having a threaded opening and a plurality of flats joined to adjacent ones thereof to define corners and extending parallel to an axis of said threaded opening, said device comprising:

a body portion having an opening for receiving said nut, said opening defines a plurality of teeth each having a cutting edge arranged for engagement with one of said flats and defined by a front face and a rear face having first and second parts, said first part extending from said cutting edge, and said second part extending from said first part and being connected to a front face of an adjacent tooth by a concave surface, said front face and said first part of each tooth being disposed at an angle of less than 90°, and said teeth having said cutting edges thereof arranged parallel to one another.

8. A device according to claim 7, wherein said first part having has a length equal to about one-half the length of a flat, as measured between a mid-portion thereof and an adjacent corner, and said second part extends from said first part to said concave surface of an adjacent tooth along an arc.

9. A device according to claim 7, wherein said first part of each of said teeth is sized to extend from adjacent a midportion of one of said flats to an adjacent corner thereof and to lie in relatively close facing relationship with said one of said flats, and said second part extends from said first part to said concave surface along an arc.

* * * * *